United States Patent [19]

Thioulouse

[11] Patent Number: 5,053,675

[45] Date of Patent: Oct. 1, 1991

[54] ELECTROLUMINESCENT DISPLAY SCREEN WITH A MEMORY AND A PARTICULAR CONFIGURATION OF ELECTRODES

[75] Inventor: Pascal Thioulouse, Paris, France

[73] Assignee: Centre National D'Etudes Des Telecommunications, Issy Les Moulineaux, France

[21] Appl. No.: 508,260

[22] Filed: Apr. 11, 1990

[30] Foreign Application Priority Data

Apr. 12, 1989 [FR] France ..... 89 04811

[51] Int. Cl.[5] ..... H05B 33/22

[52] U.S. Cl. ..... 313/505; 313/506; 313/509; 315/169.3

[58] Field of Search ..... 313/505, 506, 509, 584; 315/169.3

[56] References Cited

U.S. PATENT DOCUMENTS

| | | | |
|---|---|---|---|
| 3,786,307 | 1/1974 | Robinson | 315/169 |
| 4,602,189 | 7/1986 | Panickes | 313/505 |
| 4,614,668 | 9/1986 | Topp et al. | 313/509 |
| 4,808,880 | 2/1989 | Thioulouse | 313/509 |
| 4,877,995 | 10/1989 | Thioulouse | 313/507 |
| 4,924,144 | 5/1990 | Menn et al. | 313/505 |

FOREIGN PATENT DOCUMENTS 0259213 8/1987 European Pat. Off. .

OTHER PUBLICATIONS

Ionel Solomon & Pascal Thioulouse; "Electroluminescent Memory Display Using Amorphous Silicon-Carbon Alloys"; Oct. 3, 1989, pp. 295-302.

*Primary Examiner*—David K. Moore
*Assistant Examiner*—Rohini Khanna
*Attorney, Agent, or Firm*—Hayes, Soloway, Hennessey & Hage

[57] ABSTRACT

Electroluminescent display screen with a memory and a particular configuration of electrodes. The display screen comprises on a nonconducting substrate a stacked electroluminescent film and a photoconductive film, both of these films being inserted between lower transparent electrodes (12) orientated along a first direction (x) and upper electrodes (22) orientated along a second direction (y) perpendicular to the first direction, the upper and lower electrodes defining at their intersection picture elements (26), the upper electrodes (22) comprising blocks (40) of dimension D along the first direction at the display points electrically interconnected by two access strips (42*a*, 42*b*) with a width d with $d<D/2$, the access strips at a given block being connected by a conductive access bridge (46) parallel to the lower electrodes, the edges of these blocks (40) being situated inside the edges of the lower electrodes.

15 Claims, 8 Drawing Sheets

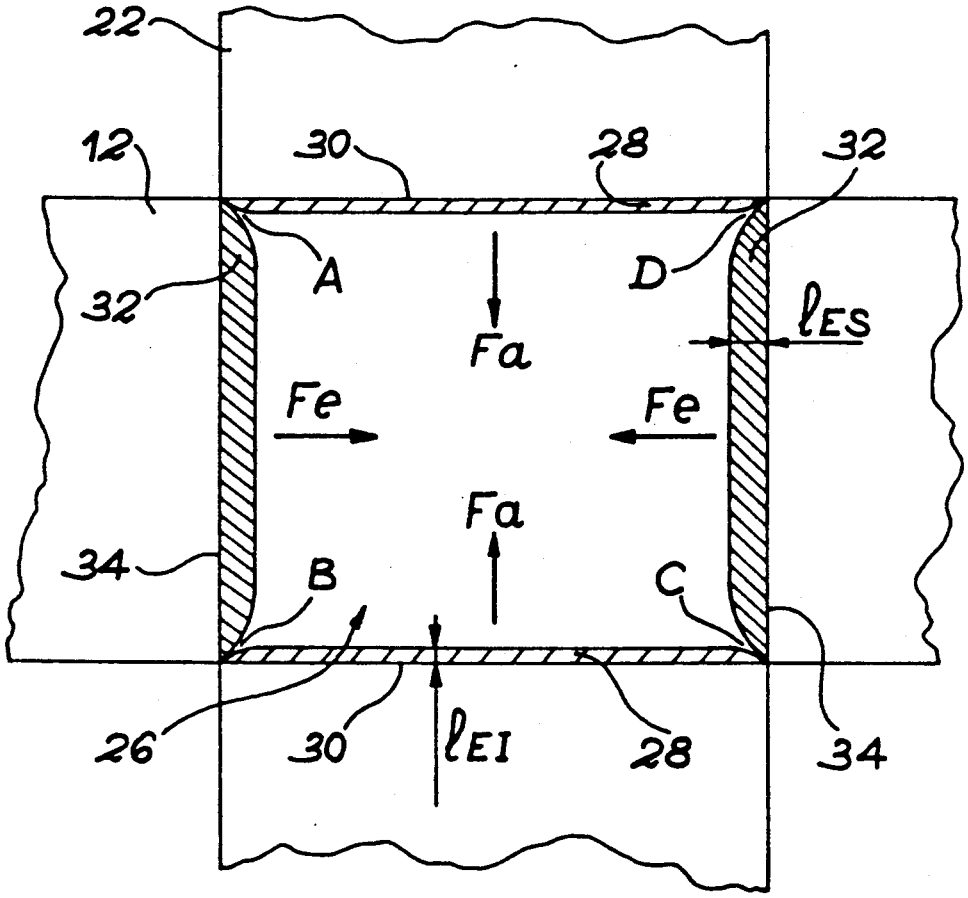
FIG. 4
FIG. 5
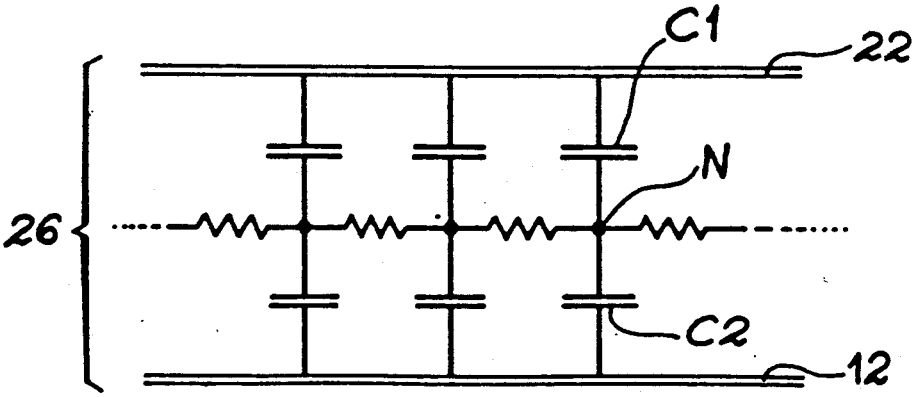

ELECTROLUMINESCENT DISPLAY SCREEN WITH A MEMORY AND A PARTICULAR CONFIGURATION OF ELECTRODES

FIELD OF THE INVENTION

The object of the present invention is to provide a flat type electroluminescent display screen with a memory able to be used in optoelectronic applications for the display of complex images or for the display of alphanumeric characters.

BACKGROUND OF THE INVENTION

A display screen is a memory display screen if its electro-optical characteristic (luminance-voltage curve) exhibits hysteresis. For a given voltage located inside the hysteresis loop, the device may thus have two stable states: switched off (unlit) or switched on (lit).

The advantages of a memory effect display are considerable: so as to display a fixed image, it merely suffices to simultaneously and continuously apply to any screen a voltage, known as a holding voltage. This voltage can be a sinusoidal signal or a signal in the form of strobes, but in particular the form and frequency of this holding signal can be selected independently of the complexity of the screen. Thus, in principle, there is no limit to the complexity of a memory display screen. Accordingly, bistable plasma screens and alternative excitation screens with 1200×1200 picture elements (pixels) are commercialized.

Furthermore, the technology of display by electroluminescence in thin films and with capactive coupling (ACTFEL for short) has now been fully evolved within industrial applications. These devices can be provided with an inherent memory effect, but at the cost of significantly deteriorating electro-optical performances. A more promising method consists of connecting a photoconductive structure (PC) in series with an electroluminescent structure (EL) and to optically couple these two structures.

Thus, it is possible to produce an extrinsic type memory effect known as a PC-El memory effect whose principle is the following: when the device is in the switched off state, the photoconductive material is slightly conductive and retains, a significant part of the voltage V applied to the unit. If V is increased to a value Von so that the voltage present at the terminals of the electroluminescent structure exceeds an electroluminescence threshold, the device PC-El tilts into the switched on state. The photoconductive material is then lit up by the electroluminescent structure and passes to the conductive state. The voltage at its terminals drops and as a result the voltage available for the electroluminescent structure increases. In order to switch off a PC-El device, it merely suffices to reduce the total voltage V to a value Voff less than Von: thus, a luminosity/voltage comprising an hysteresis is obtained.

A PC-El structure was recently described in the document FR-A-2 574 972 and in the article of the inventor and entitled "Monolithic thin-film photoconductive-ACEL structure with extrinsic memory by optical coupling" published in IEEE Transactions on Electron Devices, vol. ED-33, No. 8, August 1986, pages 1149–1153.

This structure is diagrammatically shown as a sectional view on FIG. 1. It includes a glass substrate 10 on which deposited are a transparent electrode 12, a first dielectric film 14, an El electroluminescent film 16, a second dielectric film 18, a PC photoconductive film 20 and finally a reflecting electrode 22. In this embodiment, the PC and Elfilms are thin films whose thickness is about one micrometer. The electrodes 12 and 22 are connected to an alternating or a.c. voltage 24.

For a matrix display, electrodes 12 are used, as shown on the top part of FIG. 2, said electrodes constituted by strips or groups of conductive strips parallel to each other and electrodes 22, also constituted by strips or groups of conductive strips parallel to each other, the electrodes 12 being perpendicular to the electrodes 22. The electrodes 12 and 22 indifferently play the role of line electrodes or column electrodes and are connected to control circuits 23 and 25.

Such a structure is embodied relatively simply as it does not involve any additional engraving stages. In addition, the current/voltage behaviour of the thin film photoconductor in darkness is highly non-linear and reproduceable. The favorable consequences are that the electric lighting up of the device is still relatively simple, that the hysteresis only slightly depends on the excitation frequency and that the reproductibility of the hystresis margin from one production to another is guaranteed.

In a recent publication of P. Thioulouse from the Proceedings 4th International Workshop on Electroluminescence El-88, Tottori (JP), 11–14 Oct. 1988 and entitled "Thin film photoconductor electroluminescent memory, display devices", an improved structure of the PC-Eldevice described above is proposed, said device being diagrammatically represented as a sectional view on FIG. 3. In this structure, the PC film 20 draws closer to the emitting film 16 by almost fully transferring the non-conducting film 18 situated between them above the photoconductive film 20. A fine non-conducting film 27 is then left between the films 16 and 22 so as to protect the emitting film 16.

The main advantages of this new structure are the following: better optical coupling between the films El 16 and PC 20, a virtually annulled optical guidance in the emitting film and clearly improved operating reliability with respect to the device of FIG. 1 (cicatrisation of electrical disruptive breakdowns).

The present invention is mainly applicable to this new structure.

Furthermore, it is sought to generally maximize the resistively of the PC film so as to avoid any lateral parasitic conduction (known in planar conduction terminology), the inventor has proposed and established this increase of resistivity by selecting an alloy a-$Si_{1-x}C_x$: H as a PC photoconductive material instead of the a-Si: H normally used (as regards this subject, refer to the document FR-A-2 105 777 and the aforementioned article Proceedings).

Thus, it is possible to reduce the conductivity of the intrinsic PC photoconductive material from $10^{-6}$ to $10^{-13}$ $(\Omega.cm)^{-1}$. The intrinsic photoconductive film marked i then becomes as resistive as the other films of the PC-El structure.

As described in the above-mentioned articles of the inventor and illustrated diagrammatically on FIG. 3, the PC photoconductive film is generally composed of a stacking of n+−i−n+ films. The two films n+, also with an amorphous hydrogenated silicon base, are obtained by doping with phosphorus (phosphine being added during the depositing) and aim to make it possible to inject an electronic quasi-ohmic substance into the intrinsic film.

These films n+ are significantly more conductive than the intrinsic films i and the incorporation of carbon into the material of the films nm− (a-$Si_{1-x}C_x$: H) also makes it possible to considerably reduce their conductivty, usually by $10^{-2}$-$10^{-3}$ to $10^{-5}$-$10^{-6}\Omega^{-l}$ 1.cm$^{-1}$. Unfortunately, the films n+, even those containing carbon, are still sufficiently conductive so as to provoke the parasitic phenomenon to be described subsequently.

SUMMARY OF THE INVENTION

Generally speaking, the object of the invention is to provide a PC-E1 memory type device whose structure is similar to that of FIG. 3 and in which the photoconductive film has any type of structure (n−i−n or other) and is constituted by any photoconductive material in which the lateral or "planar" conductivity is clearly much greater than that of the other materials of the PC-E1 structure (normally less than $10^{-13}\Omega^{-1}$.cm$^{-1}$).

In a matrix screen, the pixel 26 (memory point), as shown at the top of FIG. 4, is delimited by the intersection of a lower electrode 12 and an upper electrode 22.

In a crossed strip matrix display screen (FIGS. 2 and 4) with a PC-E1 structure shown on FIG. 3, two significant phenomena are observed, these phenomena adversely affecting the performances of the screen.

In the first place, on lighting up, it is possible to distinguish the appearance of a luminous border 28 at each edge 30 of the lower electrode 12 in the pixel 26; the width $\mathbf{1}_{EI}$ of this luminous border is normally from 1 to 50 micrometers.

When the voltage applied to the terminals of the pixel 26 is increased, the lighting up of the latter is started on the edges 30 of the electrode 12 and extends towards the inside of the pixel, as indicated by the arrows Fa. The lighting up voltage at the edges 30 of the lower electrode is considerably less than the intrinsic lighting up voltage (the one corresponding to a lighting up inside the pixel); the difference is normally estimated at 5-10 V. The width of hysteresis is therefore accordingly reduced. This lighting up phenomenon at the edges 30 of the lower electrodes thus has a disastrous effect on screen performances.

The second effect is observed on a lit pixel. It is noted that conversely, a zone 32 with a width $\mathbf{1}_{ES}$ of from 1 to 50 micrometers along the edges 34 of the upper electrode 22 in the pixel 26 remains extinguished.

When the voltage applied to the pixel 26 is reduced, these dark borders 32 widen, as symbolized by the arrows Fe, and may provoke a premature extinguishing of the pixel. In practice, this phenomenon may result in an increase of the extinction voltage and a reduction of the hysteresis. This effect adversely affects the display, just like the preceding effect. However, the impact on hysteresis of this second effect is generally slightly smaller.

The inventor has found that these parasitic phenomena are provoked by a lateral parasitic conduction occuring in the photoconductive film according to the plane of this film; this conduction is hereafter referred to "planar" conduction.

So as to qualitively explain these phenomena, FIG. 5 shows the electric diagram corresponding to the PC-E1 structure. This figure shows that the dielectric film 18 is represented by the capacitors $C_1$, the set of the dielectric and electroluminescent films 14, 16 and 27 being represented by the capacitors $C_2$ and the photoconductive film 20 by a resistor R within the plane of the PC film. The connecting point N of the capacitors $C_1$ and $C_2$ constitutes the node point of the PC-E1 structure.

In addition, FIG. 6 diagrammatically represents the variations of the potential Vn of the "node point" of the PC-E1 structure of a pixel according to the distance $d_s$ of the edge 34 of the upper electrode 22 and FIG. 7 shows the variations of the potential $V_n$ according to the distance $d_I$ of the edge 30 of the lower electrode 12. Also symbolized on these figures are the potential $V_{EI}$ of the lower electrode 12, the potential $V_{ES}$ of the upper electrode 22 and the potential $V_O$ corresponding to the limit value of the potential without any edge fringing.

As regards the second effect, on a lit pixel, the "planar" conductivity observed in the PC film results, in the outer region of the pixel and close to the edges 34 of the upper electrode 22, in an excitation of the films situated under the PC film (C2) giving rise to a lateral conduction from inside towards the outside of the pixel.

As represented in FIG. 6, this lateral conduction results in a fall of the voltage at the terminals of $C_2$ inside the pixel when it approaches the edge 34 of the upper electrode. The arrows I on the upper part of FIG. 6 indicate the circulation direction of the current from inside towards the outside of the pixel.

A calculation shows that the pick-up length λES is approximately proportional to $\sqrt{RC_1w}$ where w is the pulsation of the voltage applied to the pixel. By way of example, for: $R=3.10^9$ ohms per square number, $w=2\pi$kHz and $C_1=50$NF/cm2, and λES close to 10 micrometers is obtained.

The capacitor $C_2$ contains the electroluminescent film 16. Also, there is an emission of light in the zones of the films E1 where $V_n$ exceeds a threshold value Vs. According to FIG. 6, it can be seen that in a zone 32 (FIG. 4) close to the edge 34 and with a width 1ES proportional to λES, there is no luminous emission.

The problem is dealt with similarly for the first effect observed on an extinguished pixel.

A "planar" conduction also occurs in the PC film, but in the opposite direction, as indicated by the arrow I on the upper part of FIG. 7; conduction occurs from outside towards the inside of the pixel for a given polarity of the voltage applied, which corresponds to a discharge of the partially excited dielectric film 18 (capacitor $C_1$).

As indicated on the diagram of FIG. 7, this "planar" conduction results in an increase of the potential $V_n$ of the node point of the PC-E1 structure at the edge of the pixel with respect to the value $V_0$ inside the pixel. Accordingly, the voltage at the terminals of the capacitor $C_2$ is much greater at the edge 30 of the lower electrode of the pixel than inside the pixel.

The capacitor $C_2$ contains the emitting E1 film 16. Also, when the voltage at the terminals of $C_2$ exceeds a threshold value $V_s$, electroluminescent emission occurs in $C_2$. If a voltage applied to the terminals of the PC-E1 structure is selected with a value so that $V_O$ is slightly less than $V_s$, the inside of the pixel is in the extinguished state as $V_N$ is close to $V_O$ and is less than $V_s$, whereas at the edge 30 of the lower electrode of the pixel;, $V_N$ may exceed $V_S$. Then the lit up border 28 (FIG. 4) with a width $\mathbf{1}_{EI}$ is observed along the edges 30.

This lit up border generally provokes a premature lighting up of the entire pixel by the gradual propagation of the lit up state. One then observes a reduction, sometimes significant, of the lit up voltage and a result a reduction of the hysteresis margin.

As a priority, it is important to avoid this parasitic phenomenon via a suitably-adapted configuration of the electrode.

The object of the invention is also to provide an electroluminescent display screen with a memory effect and a particular configuration of the electrodes making it possible to overcome the afore-mentioned drawbacks and initially making it possible to avoid any premature lighting up of all the pixels extinguished within a lighting up threshold.

According to FIG. 4, it can be seen that there are compensation and neutralization of the edge effects of the lower and upper electrodes at the four corners A, B, C and D of each pixel 26 and that, as a result, the memory characteristics in these four corners (lighting up voltage, extinction voltage, etc) are close to those existing inside the pixel. It is this compensation phenomenon which provides the effectiveness of the invention.

More precisely, the object of the invention is to provide an electroluminescent display screen with a memory effect comprising on a non-conducting substrate:

a family of first transparent electrodes orientated parallel to a first direction, a first nonconductor covering the first electrodes, an electroluminescent film and a photoconductive material covering the entire display surface and stacked on the first nonconductor, the photoconductive material having a lateral conductivity greater than the conductivity of the other materials constituting said screen, a second nonconductor covering the photoconductive material, a family of second electrodes resting on the second nonconductor and oriented along a second direction perpendicular to the first direction, a pixel being defined by the intersection of a first electrode and a second electrode, and means to control the pixels connected to the two families of electrodes, wherein at each pixel, the second electrodes comprise blocks with the dimension D along the first direction, the blocks of a given second electrode being electrically interconnected by at least one conductive access strip with a width d along the first direction with $d<D/2$ and the edges of the second electrodes are situated inside or opposite the edges of the first electrodes.

The first electrodes are the electrodes situated between the electroluminescent film and the observer and, depending on whether or not the PC-E1 structure is "inverted", constitute the upper and lower electrodes.

The second electrodes are situated behind the photoconductive material with respect to the observer.

The fact of embodying the second electrodes in the form of blocks at the display points, interconnected by the access strips, corresponds, with respect to the state of the Art, to a significant reduction of the width of these second electrodes at the place where the latter cross the edges of the first electrodes; this makes it possible to avoid any premature lighting up of all the display points within the lighting up threshold, thus preventing the reduction of the lighting up voltage and reduction of the hysteresis margin of the luminance/-voltage characteristic of the PC-E1 screen.

Advantageously, the width ratio D/d is in the interval ranging from 3 to 300. D normally varies from 50 to 300 micrometers and d is about the width of the dark border ($1_{ES}$ on FIGS. 4 and 6) of the edge of the second electrodes so as to effectively compensate the parasitic phenomenon. With the width of the dark border $1_{ES}$ varying from 1 to 50 micrometers and usually being 10 micrometers, d is selected as being between 1 and 100 micrometers and typically is 20 micrometers.

So as to further minimize the edge effect of the second electrodes, namely the premature extinction effect of a lit pixel, the width of the first electrodes is significantly reduced with respect to the state of the Art at the place where said first electrodes cross the edges of the second electrodes. In other words, each first electrode comprises blocks with the dimension L along a second direction at the display points electrically interconnected by at least one conductive access strip of width 1 with $1<L/2$.

Advantageously, the L/1 ratio is selected in the interval ranging from 3 to 300. As previously, L varies in particular from 50 to 300 micrometers and 1 varies from 1 to 100 micrometers. Normally, L is 20 micrometers; it is of the same order of magnitude as the width $1_{EI}$ of the lit border.

The alignment precision of the edges of the first and second electrodes at the display points varies between 1 to 20 micrometers, which allows for suitable compensation of the edge effects.

According to the composition and thickness of the various forms of the PC-EL structure, the neutralization of the edge effects of the first and second electrodes is maximum, not for a perfect alignment of the edges of the first and second electrodes at the picture elements, but for the edges of the electrodes of one of the families of electrodes situated inside the edges of the electrodes of the other family of electrodes; for example, the edges of the second electrodes are situated inside the edges of the first electrodes at a given distance of between 1 and 20 micrometers and normally of 10 micrometers; conversely, the edges of the first electrodes may be situated inside the edges of the second electrodes at the display points.

According to the invention, it is also possible to use the second electrodes as parallel interconnected sub-electrodes, thus dividing each pixel into a sub-pixel, each sub-electrode then being constituted at the sub-pixels of blocks of dimension A along the first direction, the blocks of a given sub-electrode being interconnected by at least one conductive access strip of the width a with $a<A/2$, and also to use the first electrodes as parallel interconnected sub-electrodes, each comprising at each sub-pixel thus formed of blocks of dimension B along the second direction, the blocks of a given sub-electrode being interconnected by at least one conductive access strip of width b with $b<B/2$.

The second electrodes may be made of a transparent material or an opaque material, depending on whether or not one wishes to obtain a completely transparent display screen.

According to the invention, the conductive blocks and their access strips of a given electrode or a given sub-electrode are simultaneously embodied in a given conductive film.

BRIEF DESCRIPTION OF THE DRAWINGS

Other characteristics and advantages of the invention shall appear more readily from a reading of the following description, given by way of illustration and being in no way restrictive, with reference to FIGS. 8 to 12, FIGS. 1 to 7 having already been described as a memory type device.

DETAILED DESCRIPTION OF THE PREFERRED EMBODIMENTS

Figure 1:
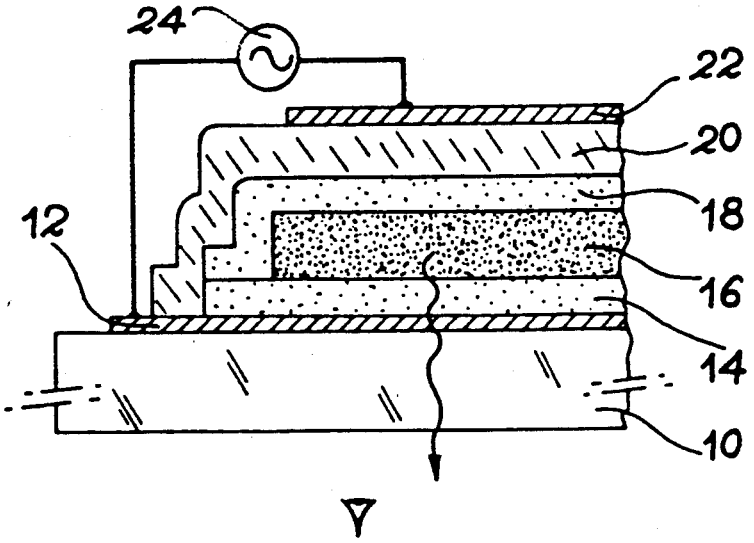
Figure 2:
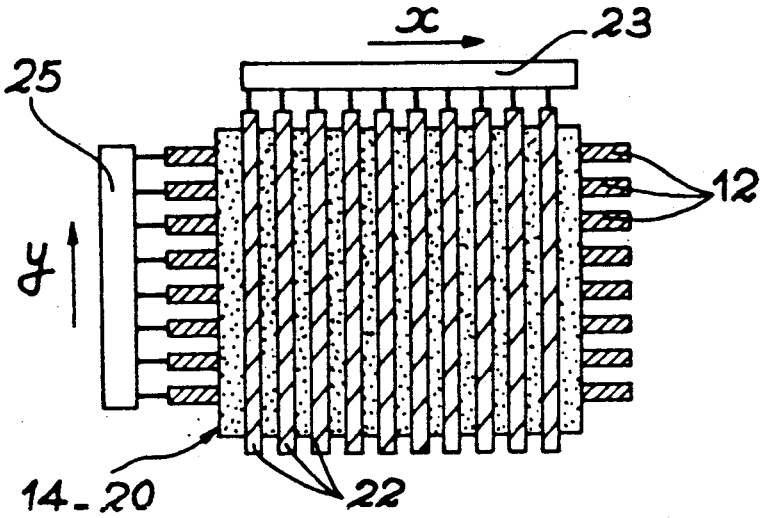

The display screen of the invention only differs from screens of the prior Art by the configuration of the electrodes. In particular, the display screen comprises a transparent glass substrate 10 covered with ITO electrodes 12 orientated along a first direction x (see FIG. 2) and having a thickness of 150 nm. These lower electrodes 12 are covered with a dielectric film 14 supporting a film made of an electroluminescent material 16. The electroluminescent material may be constituted by one or more films of different electroluminescent materials.

The electroluminescent materials able to be used in the invention are, in particular, those described in the article by Shosaku Tanaka and al in SID-88 DIGEST. 293–296 and entitled "Bright-White-Light electroluminescent Device with New Phospohor Thin Films Based on SRS", those mentioned in the article by Hiroshi Kobayashi and entitled "Recent Development of Multi-Color Thin Film Electroluminescence Research" in Abstract n· 1231, p. 1712–1713, Extended Abstracts of electrochemical Society Meeting, vol. 87-2 of the 18th–23rd Oct. 1987 or even in the article by Shosaku Tanaka and entitled "Color Electroluminescence in Alcalin-Earth Sulfide Thin Films" in the Journal of Luminescence 40 and 41 (1988), p. 20–23.

For example, the E1 film 16 is made of ZnS:Mn.

The electroluminescent film 16 is preferably covered with a nonconductor 27 supporting a photoconductive material 20 in the form of a continuous film constituted in particular by a-$Si_{1-x}C_x$/H with x' ranging from 0 to 1 and preferably ranging from 0 to 0.5. This material 20 is constituted by three stacked film $n^+-i-n^+$, the film n being obtained by doping with the phosphorus of the a-$Si_{1-x}C_x$:H.

The electroluminescent film and the photoconductive material cover the entire display surface of the screen.

The photoconductive material is covered with a nonconductor 18 supporting the electrodes 22 and is made of an opaque or reflecting material, such as aluminium. The electrodes 22 are orientated along the direction y perpendicular to the direction x.

The photoconductive film has a thickness of 1 micrometer, the electroluminescent film 16 a thickness of between 0.5 and 2 micrometers and the dielectric films 14, 27, 18 may be made of one of any of the selected materials from $Si_3N_4$, $SiO_2$, $SiO_xN_y$, $Ta_2O_5$ and have a thickness of between 20 and 400 nm.

Figure 3:
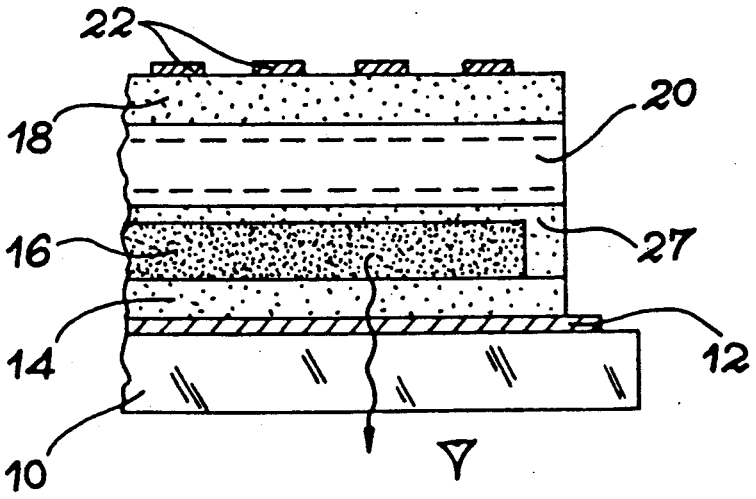
Figure 6:
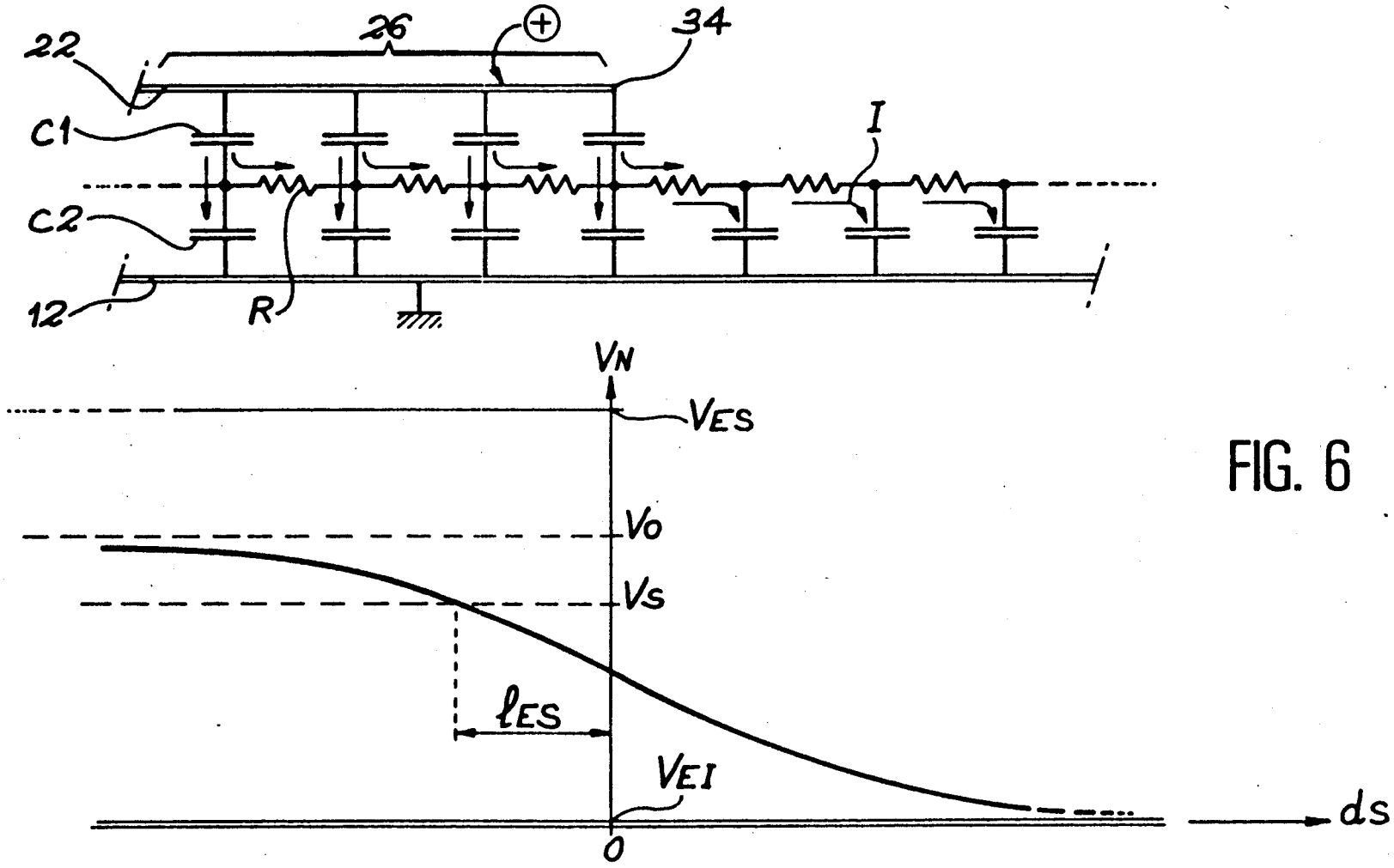
Figure 7:
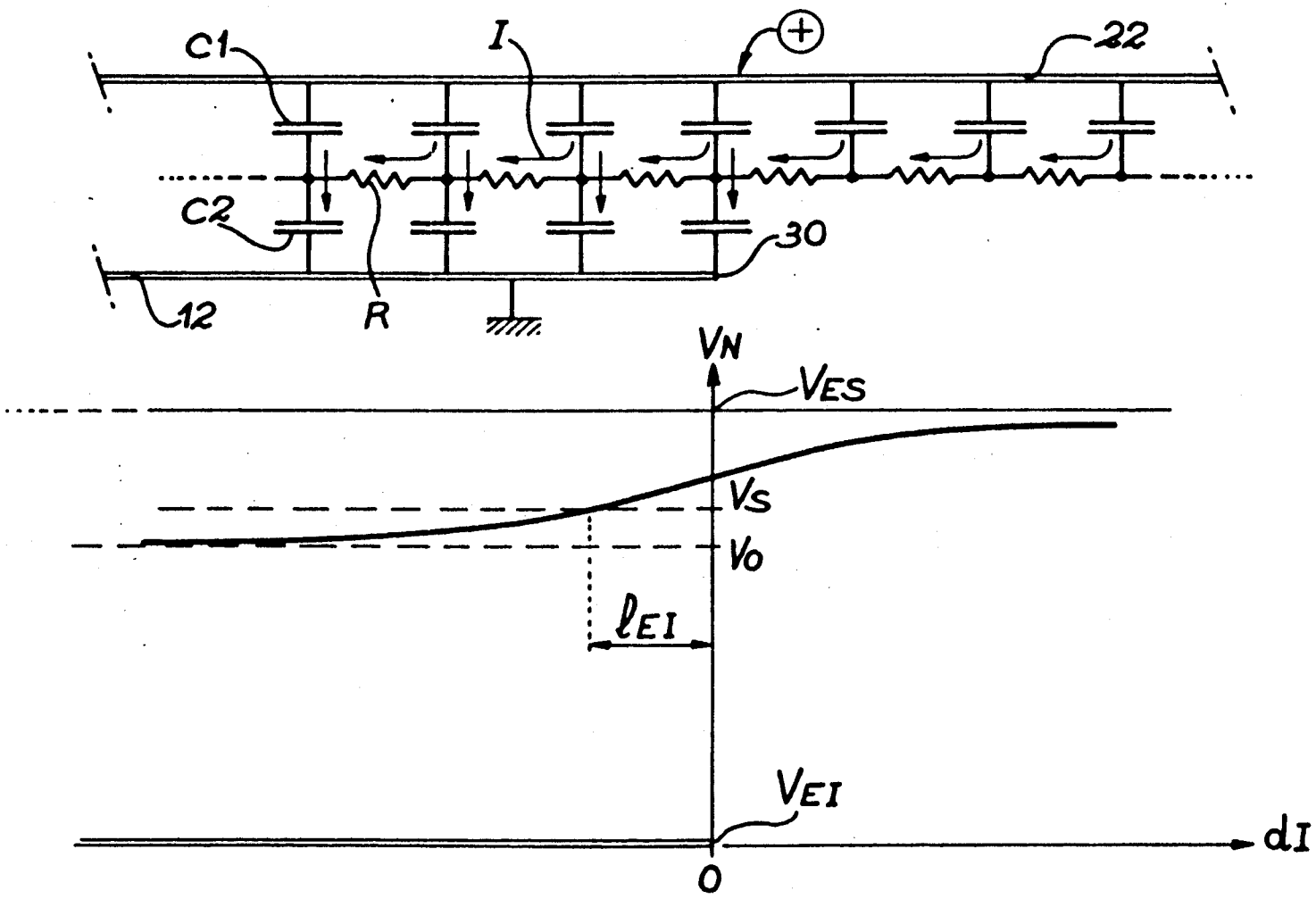

The means for controlling the display screen are symbolized by the blocks 23 and 25 (FIG. 3) and do not differ from those of the prior Art.

Figure 8:
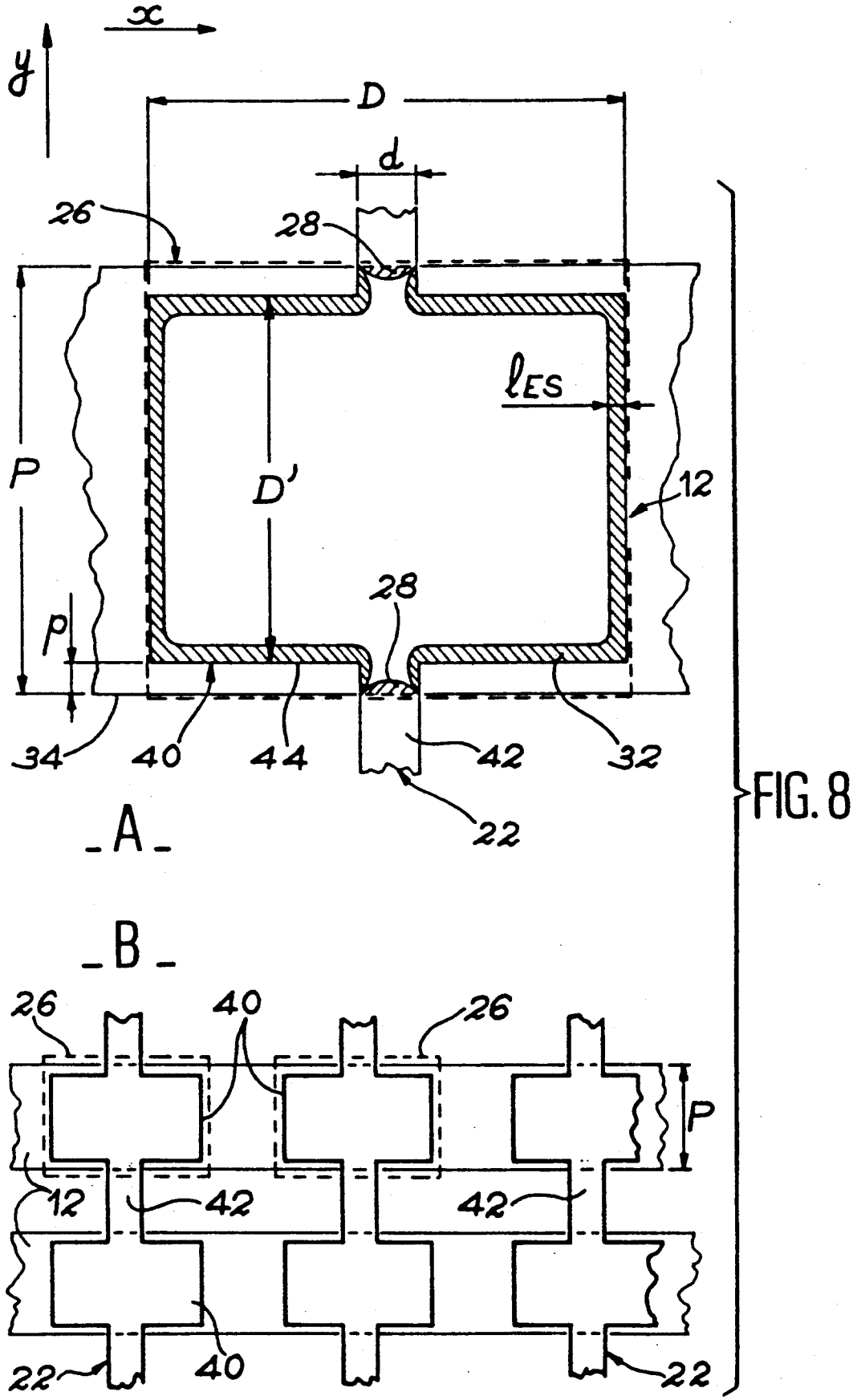
FIGS. 8 to 11 represent various configurations of electrodes according to the invention and FIG. 12 represents a display screen with an "inverted" structure.

The electrode configuration represented at the top on parts A and B of FIG. 8 mainly make it possible to avoid any premature lighting of the unlit display points 26. Part A illustrates the disposition of the electrodes at a display point 26 and part B shows a view of the entire configuration of part A.

In this configuration, the lower electrodes 12 appear in the form of continuous conductive strips having a constant width p and the upper electrodes 22 are constituted by rectangular conductive blocks 40 of dimension D along the direction x and being electrically interconnected by a conductive access strip 42 of width d along the direction x with $d<D/2$.

By means of this configuration of electrodes, the dark border 32 appears on the entire periphery of the block 40 and the light border 28 only appears in the access strip 42, thus avoiding any premature lighting of the pixel.

For a dark border 32 of the lit up pixel 26 with a width of $1_{ES}$, the access strip 42 has a width d of the same order of magnitude as $1_{ES}$.

When the lower electrodes 12 appear in the form of strips with a constant width (FIG. 8), it is essential that these conductive strips have a width p greater than or equal to the dimension D' along the direction y of the blocks. In other words, the blocks 40 are completely contained inside the conductive strips 12.

This width p is considered as being sufficiently large so as to favorize the compensation effect and so as to facilitate the alignment of the upper electrodes 22 with respect to the lower electrodes. This width defines the required alignment precision, that is the distance p separating the edges 44 of the blocks 40 from the edges 34 of the lower electrodes 12. This precision is generally selected with an order of magnitude of d and typically is 20 micrometers, which corresponds to a distance p equal to about 10 micrometers.

The larger the selected distance p is, the easier it is to embody the compensation effect and the easier it is to align the network of lower electrodes with respect to the upper electrodes.

Figure 9:
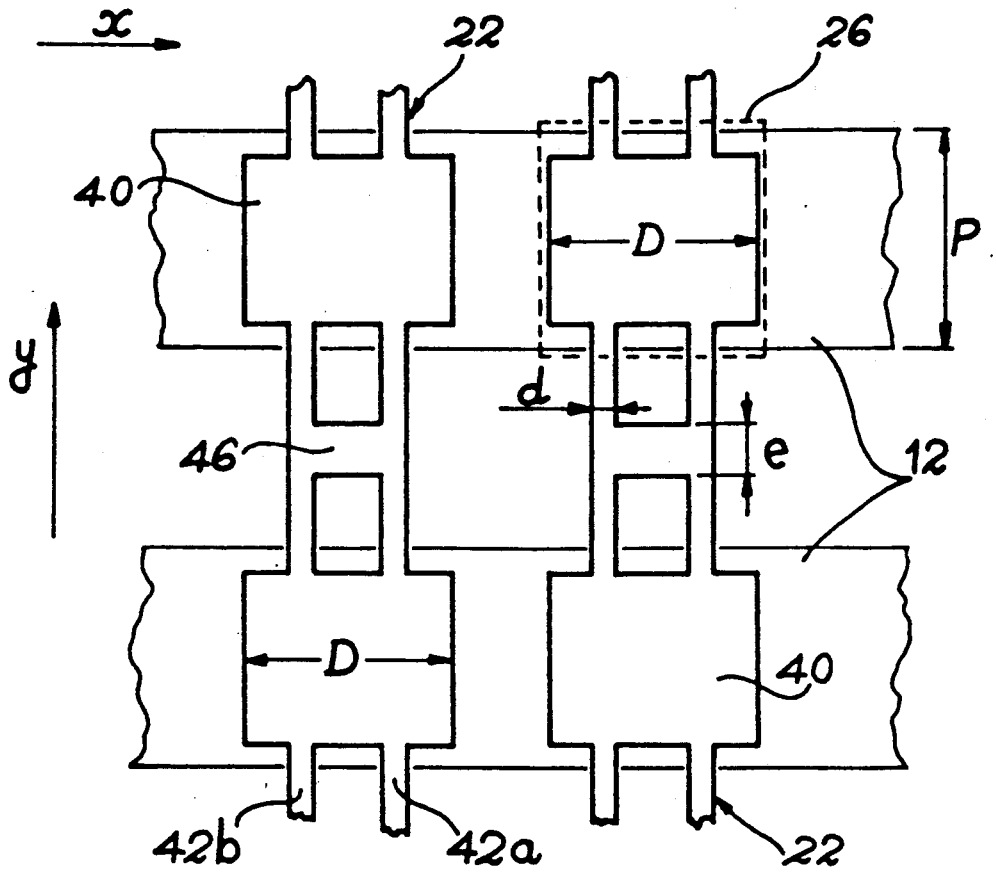

One improvement of the configuration of FIG. 8 consists of multiplying the number of access strips at the blocks 40 of the upper electrodes 22. This is shown of FIG. 9. This figure shows that each block is equipped with two access strips **42*a* and 42*b* parallel to each other. Of course, the number of access strips at each block 40** may be more.

The narrowness of an access strip 42 (FIG. 8) at the blocks 40 of the upper electrodes increases the risk of accidentally disconnecting these electrodes (dust, scratch). Also, the redundancy brought about by the use of several access strips preserves the electrical continuity of the upper electrodes 22 in the event of any possible disconnection of an access strip, which significantly reduces the risk of the total disconnection of these electrodes 22.

So as to further reduce the risk of disconnecting the electrodes 22, it is possible to connect the access strips **42*a* and 42*b* of a given block 40 with the aid of a conductive bridge 46 situated outside the strips of the upper electrodes 12. The multiple access strips 42*a* and 42*b* are parallel to the direction y, whereas the bridges 46 are orientated along the direction x parallel to the lower electrodes 12**.

By way of example, the conductive strips constituting the upper electrodes 12 have a constant width p of 200 micrometers and are separated by 100 micrometers; the blocks 40 constituting the upper electrodes 22 have a dimension D of 200 micrometers and a dimension D' of 160 micrometers; the access strips 42, **42*a* and 42*b* have a width d of 20 micrometers; the bridges 46 have a width e of 40 micrometers; the blocks 40 of a given electrode 22 are separate from each other by 140 micrometers and the blocks of two consecutive electrodes 22** are separated by 100 micrometers.

Figure 10A:
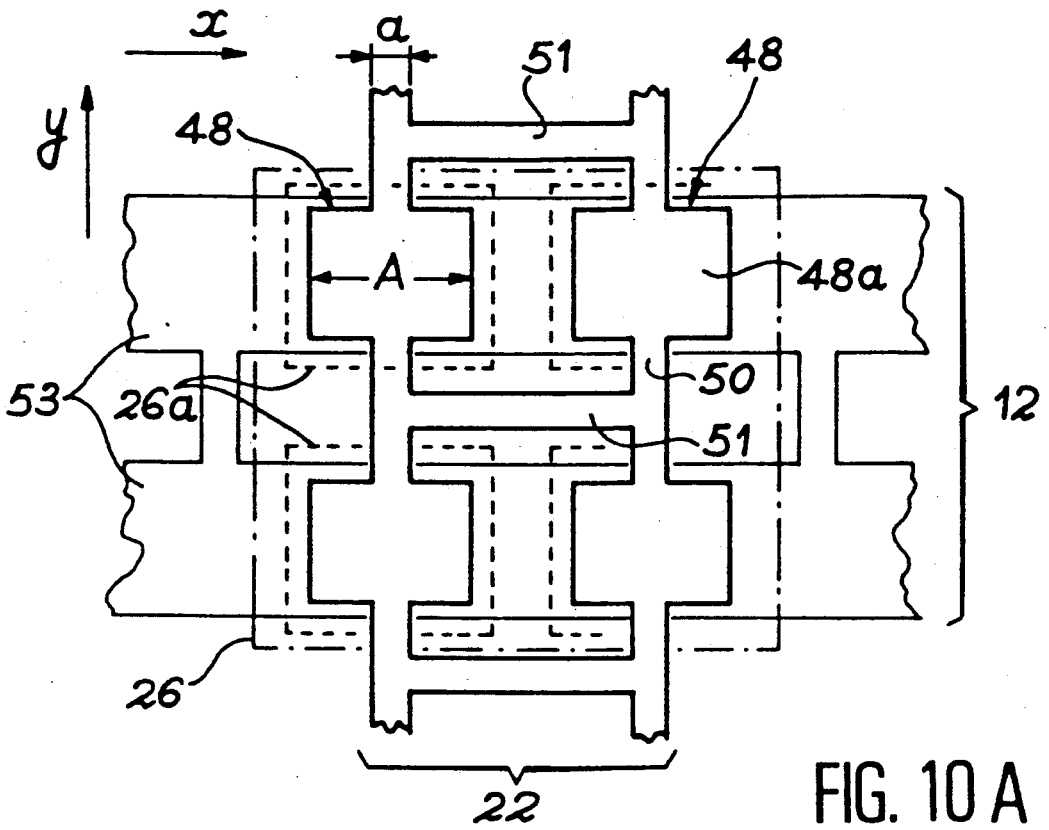

As shown on FIG. 10A, it is also possible to divide at each pixel 26 the upper electrodes 22 into the form of sub-electrodes 48, as described in the document FR-A-2

602 897 filed in the name of the inventor. These sub-electrodes 48 are interconnected by conductive links 51 and define sub-pixels 26*a*. They are parallel and orientated along the direction y.

According to the invention, each sub-electrode 48 at the sub-pixels 26*a* is constituted by blocks 48*a* having a dimension A along the direction x, these blocks being electrically interconnected by one or more conductive strips 50 of width a along the direction x with $a<A/2$. In particular, A/a is selected in the interval ranging from 3 to 300.

The lower electrodes 12 may also be divided into parallel electrically interconnected sub-electrodes. These lower electrodes 12 may appear in the form of continuous parallel strips 53 with a constant width, as shown on FIG. 10A.

The considerations previously made at each pixel (FIGS. 8–9) are in this case applicable to each sub-pixel. Also, so as to avoid the premature lighting of the sub-pixels 26*a* when the sub-electrodes 53 of the lower electrodes are in the form of strips with a constant width (FIG. 10A), it is essential that the edges of the blocks 48*a* of the upper sub-electrodes are situated inside or opposite the edges of the sub-electrodes 53.

Figure 10B:
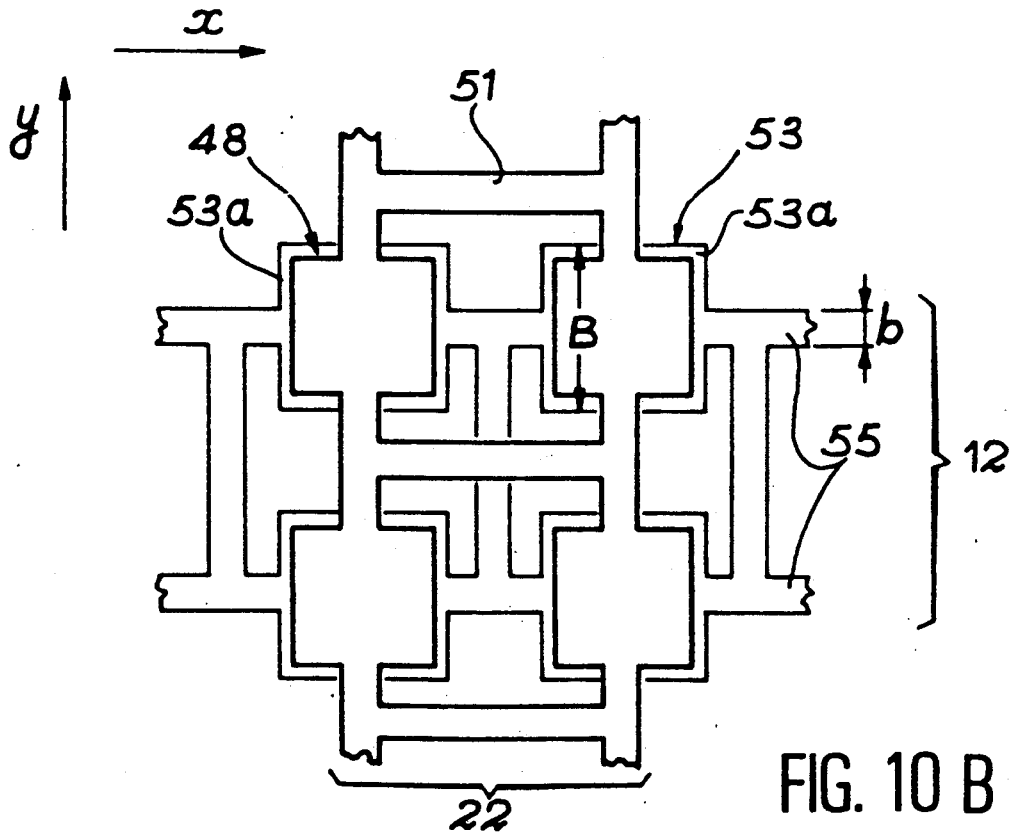

According to the invention, it is also possible to use the sub-electrodes 53, at each sub-pixel they define with the upper electrodes and as shown on FIG. 10B, as block 53*a* of dimension B along the direction y electrically interconnected by access strips 55 of width b along the direction y with $b<B/2$. In particular, B/b is selected in the interval ranging from 3 to 300.

Figure 11:
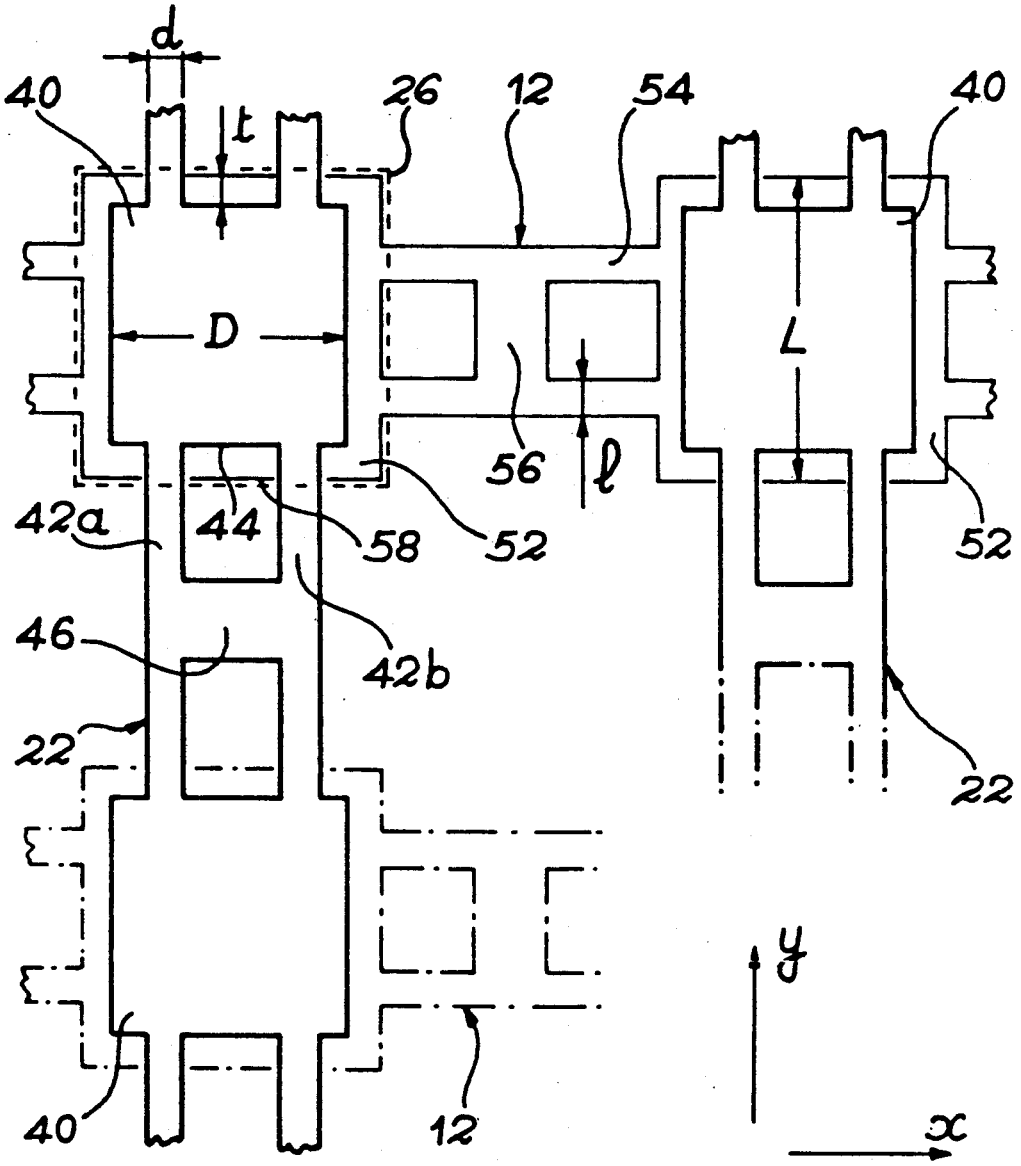

The considerations made subsequently at each pixel 26 with reference to FIG. 11 are then applicable to each sub-pixel.

In particular, the blocks 48*a* are entirely housed in the blocks 53*a*, the distance separating the edges of the blocks 48*a* from those of the blocks 53*a* being about 10 micrometers. Conversely, it is subsequently possible to dispose the blocks 53*a* inside the blocks 48*a*.

as shown on FIG. 11, it is also possible to significantly reduce with respect to the prior Art the width of the lower electrodes 12 at the location where they cross the edge of the upper electrodes 22. Also, the lower electrodes 12 are constituted by conductive rectangular blocks 52 of dimension L along the direction y at each display point 26, these blocks 52 being electrically interconnected by conductive access strips 54 having a width 1 along the direction y with $1<L/2$.

The configuration of the access strips 54 at the blocks 52 of the lower electrodes 12 is similar to that of the access strips 42, 42*a* and 42*b* of the upper electrodes. In particular, these access strips may amount to two, as shown on FIG. 11, and be interconnected by the conductive bridges 56.

The configuration of electrodes shown on FIG. 11 is used to minimize the edge effects of the upper electrodes 22, namely the premature extinction effect, whilst minimizing the edge effect of the lower electrodes 12, namely the premature lighting effect.

So that the edge effects are compensated as best as possible, the edges 44 of the blocks 40 of the upper electrodes 22 and the edges 58 of the blocks 52 of the lower electrodes 12 need to be aligned as precisely as possible. The alignment precision of the edges 44 and 58 varies between 1 and 20 micrometers.

So as to favor this compensation of the edge effects, the edges 44 of the blocks 40 of the upper electrodes are preferably selected situated inside the edges 58 of the blocks 52 of the lower electrodes. The distance t separating the edges 44 and 58 is about 10 micrometers.

In particular, 1 and d of the respective access strips 54 and 42 are equal to 20 micrometers, the dimensions of the blocks 40 and 52 along the direction x respectively being 180 and 200 micrometers and the dimensions of the blocks 40 and 52 along the direction y being also respectively 180 and 200 micrometers for the configuration represented on FIG. 11 (let $L=200$ micrometers and $D=180$ micrometers).

It is also possible embody the lower and upper electrodes so that the edges 58 of the blocks 52 are situated inside the edges 44 of the blocks 40.

Figure 12:
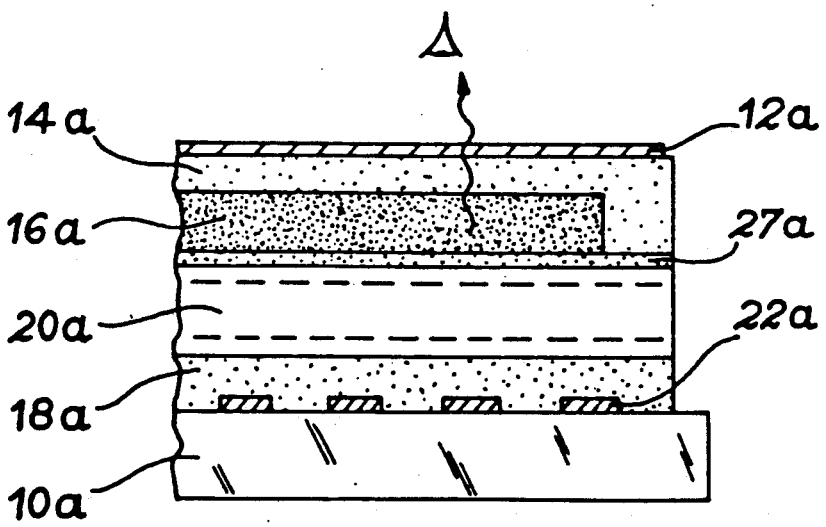

The preceding description concerned a display screen with a transparent substrate through which the observation is made. However, it is possible to apply the invention to an "inverted" PC-E1 structure display screen, as shown on FIG. 12. The essential elements of this "inverted" structure, identical to those described previously, bear the same reference associated with the letter a.

From bottom to top, this screen includes a substrate 10*a*, opaque column electrodes 22*a*, a first nonconductor 18*a*, the photoconductive film 20*a*, a second nonconductor 27*a*, the electroluminescent film 16*a*, a third nonconductor 14*a* and finally the transparent line electrodes 12*a* through which the observation is made.

In this structure, is it the opaque or reflecting electrodes 22*a* which are in contact with the substrate and not the transparent electrodes 12*a*. The substrate 10*a* may therefore is opaque.

What is claimed is:

1. Electroluminescent display screen with a memory effect and comprising on a non-conducting substrate:

a family of first transparent electrodes parallel to a first direction, a first nonconductor covering the first electrodes, an electroluminescent film and a photoconductive material covering the entire display surface and stacked on the first nonconductor, the photoconductive material having a lateral conductivity greater than that of the other materials constituting said screen, a second nonconductor covering the photoconductive material, a family of second electrodes resting on the second nonconductor and orientated along a second direction perpendicular to the first direction, a pixel being defined by the intersection of a first electrode and a second electrode, and means for controlling the pixels connected to the two families of electrodes, wherein at each pixel the second electrodes comprise blocks of dimension D along the first direction, the blocks of a given second electrode being electrically interconnected by at least one conductive access strip of width d along the first direction with $d<D/2$ and the edges of the second electrodes being situated inside or opposite the edges of the first electrodes.

2. Electrolunimescent display screen with a memory effect and comprising on a non-conducting substrate:

a family of first transparent electrodes orientated parallel to a first direction, a first nonconductor covering the first electrodes, an electroluminescent film and a photoconductive material covering the entire display surface and stacked on the first nonconductor, the photoconductive material having a lateral conductivity greater than that of the other materials constituting said screen, a second nonconductor covering the photoconductive material, a family of second electrodes resting on the second nonconductor and orientated along a second direction perpendicular to the first direction, a pixel being defined by the intersection of a first electrode and a second electrode, and means for controlling the pixels connected to the two families of electrodes, wherein as each pixel the second electrodes comprise blocks of dimension D along the first direction, the blocks of a given second electrode being electrically interconnected by at least one conductive access strip of width d along the first direction with $d<D/2$, the first electrodes comprising blocks of dimension L along the second direction, the blocks of each first electrode being electrically interconnected by at least one conductive access strip of width 1 along the second direction with $1<L/2$, and the edges of the electrodes of one of the two families of electrodes being situated inside the edges of the electrodes of the other family of electrodes.

3. Display screen according to claim 1, wherein the ratio of block dimension D to strip width d, D/d is in the range of from 3 to 300.

4. Display screen according to claim 2, wherein the edges of the second electrodes are situated at each pixel inside the edges of the first electrodes.

5. Display screen according to claim 1, wherein the number of access strips connecting two consecutive blocks of a given second electrode is at least equal to 2.

6. Display screen according to claim 5, wherein the access strips at a given block of the second electrodes are interconnected by a conductive bridge essentially parallel to the first electrodes and situated outside the latter.

7. Display screen according to claim 1, wherein the ratio of block dimension L to strip width 1, L/1 is in the range of from 3 to 300.

8. Display screen according to claim 1, wherein the distance separating the edges of the first and second electrodes at the pixels is in the range of from 1 to 20 micrometers.

9. Display screen according to claim 2, wherein the number of access strips connecting two consecutive blocks of a given first electrode is at least equal to 2.

10. Display screen according to claim 9, wherein the access strips at a given block of the first electrodes are interconnected by a conductive bridge parallel to the second electrodes and situated outside the latter.

11. Memory effect electroluminescent display screen comprising on a non-conducting substrate:

a family of first transparent electrodes orientated parallel to a first direction, a first nonconductor covering the first electrodes, an electroluminescent film and a photoconductive material covering the entire display surface and stacked on the first nonconductor, the photoconductive material having a lateral conductivity greater than that of the other materials constituting said screen, a second nonconductor covering the photoconductive material, a family of second electrodes resting on the second nonconductor and orientated along a second direction perpendicular to the first direction, a pixel being defined by the intersection of a first electrode and a second electrode, and means to control the pixels connected to the two families of electrodes, wherein each second electrode is constituted at the pixels of first parallel electrically interconnected sub-electrodes thus defining the sub-pixels, these first sub-electrodes comprising blocks of dimension A along the first direction at each sub-pixel, the blocks of a given first sub-electrode being electrically interconnected by at least one conductive access strip of width a along the first direction with $a<A/2$, the edges of these first sub-electrodes at the sub-pixels being situated inside or opposite the edges of the first electrodes.

12. Memory effect electroluminescent display screen comprising on a non-conducting substrate:

a family of first transparent electrodes orientated parallel to a first direction, a first nonconductor covering the first electrodes, an electroluminescent film and a photoconductive material covering the entire display surface and stacked on the first nonconductor, the photoconductive material having a lateral conductivity greater than that of the other materials constituting said screen, a second nonconductor covering the photoconductive material, a family of second electrodes resting on the second nonconductor and orientated along a second direction perpendicular to the first direction, a pixel being defined by the intersection of a first electrode and a second electrode, and means to control the pixels connected to the two families of electrodes, wherein each second electrode is constituted at the pixels by first electrically interconnected parallel sub-electrodes, each first electrode being constituted at the pixels by second electrically interconnected parallel sub-electrodes, the first and second sub-electrodes defining at their intersection sub-pixels, these first sub-electrodes comprising blocks of dimension A along the first direction as regards each sub-pixel, the blocks of a given first sub-electrode being electrically interconnected by at least one conductive access strip of width a along the first direction with $a<A/2$, these second sub-electrodes comprising blocks of dimension B along the second direction as regards each sub-pixel, the blocks of a given second sub-electrode being electrically interconnected by at least one conductive access strip of width b along the second direction with $b<B/2$, and wherein the edges of the sub-electrodes of one of the two families of sub-electrodes as regards each sub-pixel being situated inside the edges of the sub-electrodes of the other family of sub-electrodes.

13. Display screen according to claim 1, wherein an intermediate nonconductor is provided between the electroluminescent film and the photoconductive material.

14. Display screen according to claim 1, wherein the second electrodes are made of a reflecting material.

15. Display screen according to claim 2, wherein the ratio D/d is included in the interval ranging from 3 to 300.

* * * * *

UNITED STATES PATENT AND TRADEMARK OFFICE

CERTIFICATE OF CORRECTION

PATENT NO. : 5,053,675

DATED : October 1, 1991

INVENTOR(S) : Pascal Thioulouse

It is certified that error appears in the above-identified patent and that said Letters Patent is hereby corrected as shown below:

"Claim 2, col. 11, line 10, "as" should be "at".

Signed and Sealed this

Ninth Day of February, 1993

*Attest:*

STEPHEN G. KUNIN

*Attesting Officer*

*Acting Commissioner of Patents and Trademarks*